United States Patent [19]

Sakudo et al.

[11] 4,058,748

[45] Nov. 15, 1977

[54] MICROWAVE DISCHARGE ION SOURCE

[75] Inventors: Noriyuki Sakudo, Ome; Katsumi Tokiguchi, Kokubunji; Ichiro Kanomata, Fuchu, all of Japan

[73] Assignee: Hitachi, Ltd., Japan

[21] Appl. No.: 686,121

[22] Filed: May 13, 1976

[51] Int. Cl.[2] ..... H01J 27/00

[52] U.S. Cl. ..... 313/156; 313/161; 313/230; 313/231.3

[58] Field of Search ..... 313/153, 156, 161, 230, 313/231.3

[56] References Cited

U.S. PATENT DOCUMENTS 3,744,247 7/1973 Margosian et al. ..... 313/230 X

*Primary Examiner*—Rudolph V. Rolinec
*Assistant Examiner*—Darwin R. Hostetter
*Attorney, Agent, or Firm*—Craig & Antonelli

[57] ABSTRACT

An ion source for emitting an efficient radiation of ion beam having a rectangular cross section includes a set of parallel electrodes to which a microwave power is supplied to generate a microwave electric field in an electrode gap. A DC magnetic field is applied in a direction along the opposing surfaces of the electrodes to provide a microwave discharge in the electrode gap in cooperation with the microwave electric field crossing therewith. The electrode gap or discharge space has a rectangular cross section perpendicular to a direction along which ions produced by the microwave discharge are extracted as an ion beam with a side of the cross section corresponding to the distance between the electrodes being shorter than its side crossing therewith. This allows the efficient generation of the ion beam having the rectangular cross section through one or more extraction electrodes which include rectangular slits corresponding in pattern to the above-mentioned cross section.

13 Claims, 20 Drawing Figures

MICROWAVE DISCHARGE ION SOURCE

The present invention relates to an ion source for generating an ion beam using a microwave discharge, and more particularly to an ion source for generating an ion beam, adapted for use in separating ions having a predetermined mass with high resolving power.

Ions are recently in popular use in various technical fields, for example, in an ion implantation, ion beam deposition, ion plating, plasma sputtering and analysing devices in which ions are used.

In an ion source capable of producing a large ion current, a plasma is generally produced by ionization due to the electron bombardment in the gas discharge to extract ions therefrom.

Conventionally, an ion source in which a low voltage arc discharge is utilized has widely been used as the ion source for producing a large ion current. This ion source, however, has the drawbacks that ions are taken as an ion beam out of the ion source with a low efficiency, discharge conditions are unstable, and the cathode is corroded by a discharge gas with the result of consumption or breakage. In order to eliminate the drawbacks, a microwave discharge is taken into account for use as the ion source. In other words, the microwave discharge has the advantages that the fluctuation of plasma resulting from the surface conditions of the cathode can be avoided because of no presence of the cathode, the discharge is caused to occur at a low pressure, and it has high power efficiency. The microwave discharge ion source which has conventionally been used, however, has a structure in which a microwave source is simply coupled through a coaxial line to a discharge space region, which is thus in the form of a cylinder, as will be described later. The ions, therefore, decreases remarkably in use efficiency in extracting therefrom an ion beam of rectangular cross section through a slit for mass separation by means of a mass spectrograph.

A primary object of the present invention is to provide a microwave discharge ion source capable of extracting an ion beam having a substantially rectangular cross section and strong intensity.

Another object of the present invention is to provide a microwave discharge ion beam including a discharge space having a substantially rectangular cross section perpendicular to the extracted ion beam.

A further object of the present invention is to provide a microwave discharge ion source in which the cross section of the discharge space perpendicular to the extracted ion beam is substantially the same in shape as the substantially rectangular slit which provides to the ion beam a cross section through which the extracted ion beam can exhibit a high resolving power in the mass separation by means of the mass spectrograph.

Still another object of the present invention is to provide a microwave discharge ion source in which the microwave discharge occurs only in the proximity of an electrode gap defined by a set of parallel electrodes arranged in opposing and slightly spaced relationship, and a plasma has an slender cross section in a plane perpendicular to the direction of the extracted ion beam.

Still a further object of the present invention is to provide a microwave discharge ion source capable of generating the plasma having the slender cross section by means of a commercially available microwave oscillator which is relatively inexpensive.

According to the present invention achieving the above-mentioned objects, a microwave discharge ion source is provided which comprises a set of conductive members for producing a microwave electric field therebetween, means for generating a magnetic field in a direction perpendicular to said microwave electric field, means for introducing a sample gas or vapor, at least one extraction electrode for taking ions out of a plasma produced by a microwave discharge which occurs in the atmosphere of the introduced sample gas or vapor in cooperation with said microwave electric field and said magnetic field, and a vacuum-sealing insulator provided at an end portion opposite to the end portion at which said extraction electrode is provided, wherein said set of conductive members are a set of electrodes having their surfaces arranged in opposing and substantially parallel relationship; a discharge space defined in the proximity of an electrode gap between said electrodes has a cross section substantially rectangular in a plane perpendicular to a direction along which the ions are extracted; said extraction electrode is provided with a slit having substantially the same pattern as that of said rectangular cross section, an ion beam having a rectangular cross section being extracted through said slit; and said vacuum-sealing insulator is made of a conductor material at a position at which it comes into contact with said electrodes, said conductor material being vacuum-tightly attached to said vacuum-sealing insulator.

The other objects, functions and advantages will be understood from the following detailed description made with reference to the accompanying drawings, in which.

Figure 1:
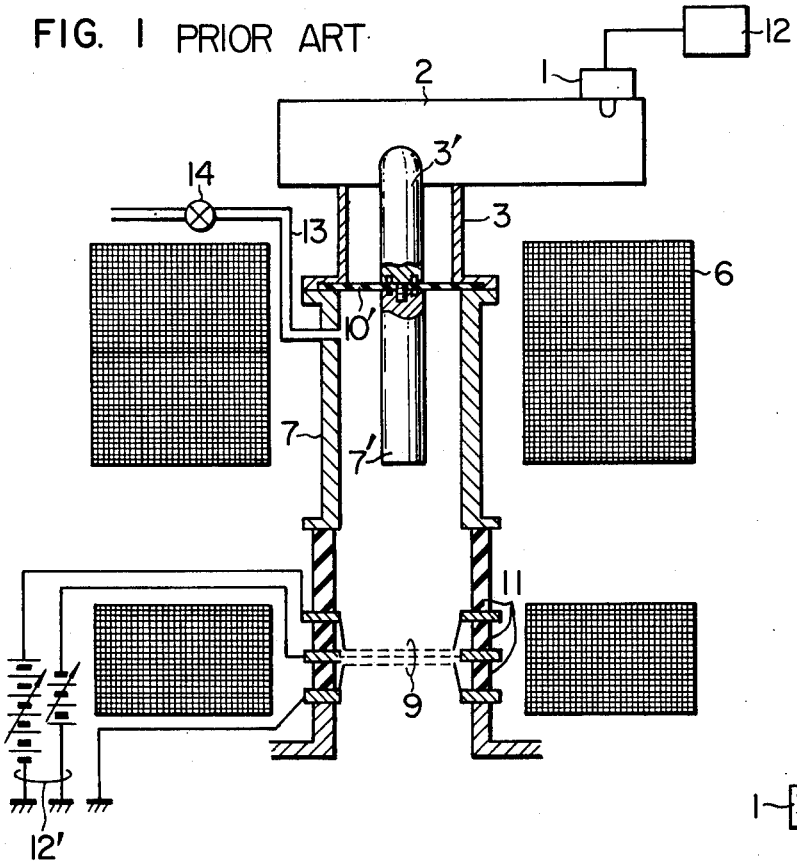
FIG. 1 PRIOR ART
FIG. 1 is a schematic cross section showing a conventional microwave discharge ion source.

In order for the features of the present invention to be made more clear, a conventional microwave discharge ion source will be described with reference to FIG. 1 prior to the description of the embodiments according to the present invention. In FIG. 1, reference numeral 1 shows a magnetron for generating a microwave; 2 a rectangular waveguide coupled to the magnetron 1; 3 a coaxial cable connected to the rectangular waveguide; 3' an inner conductor in the coaxial cable 3; 6 magnetic coils for generating a mirror magnetic field in a discharge portion; 7 an outer conductor in the discharge portion (in this case, coaxial cylindrical discharge portion); 7' an inner conductor in the discharge portion; 9 a group of electrodes for taking an ion beam out of the discharge portion; 11 insulating materials; 12 a power supply for supplying electric power to the magnetron; 12' a power supply for supplying a bias voltage to the group of electrodes 9; 13 a pipe for intriducing a discharge gas to the discharge portion; and 14 a valve provided in the pipe 13. It is to be noted that each of the electrodes 9 is provided with a plurality of small holes, through which ions are extracted. The ion source with such a structure as shown in FIG. 1 is used, for example, under the following conditions:

| | |
|---|---|
| oscillation frequency of the magnetron, | 2.45 GHz; |
| output of the magnetron, | 600 W; |
| inner diameter of the outer conductor in the discharge portion, | 50 mm; |
| diameter of the inner conductor in the discharge portion, | 12 mm; |
| intensity of the mirror magnetic field, 2 to 3 Kilogausses at a portion having a maximum intensity; | |
| group of electrodes, comprising three circular discs, each of which is 44 mm in diameter and is provided with 121 small holes each having a diameter of 3 mm; | |
| pressure of the discharge gas, $1 \times 10^{-2}$ to $1 \times 10^{-4}$ Torr; and | |
| circuit density of ions to be extracted, 15 to 30 mA/cm$^2$. | |

The ion beam produced with the above-mentioned structure usually contains not only ions of desired elements, but also those of useless elements. It is necessary to pass the ion beam through a DC magnetic field and separate therefrom only ions having the desired mass number, when the ion source is employed in such various technical fields as mentioned above, for example, in the ion implantation. The ion beam extracted from the ion source is, however, circular in cross section, so that it cannot have a sufficient resolving power ($M/\Delta M$, M being the mass number) when the beam is mass-analysed in the DC magnetic field. On the other hand, the use of a group of electrodes with a rectangular slit instead of those with a plurality of small holes allows an ion beam rectangular in cross section to be extracted, but causes the ion extraction efficiency to decrease remarkably for the following reasons. The ions in the plasma generated in the discharge space are generally diffused in all directions, and most of them collide against walls defining the discharge space and become extinguished. Some of the diffusing ions, which have passed through the slit, are extracted as an ion beam. When the electrodes provided with the above-mentioned rectangular slit are used, the slit must, for example, be 3 mm × 20 mm great so that the extracted ion beam may be subjected to mass separation with a sufficiently high resolving power. The effective area through which the ions are extracted is about 850 mm$^2$ in the conventional electrode structure provided with 121 small holes each having a diameter of 3 mm as shown above, while it is 60 mm$^2$ in the electrode structure with the rectangular slit. The use of the rectangular slit, therefore, causes the ion extraction efficiency to be reduced to about one-fifteenth. Such a great reduction in efficiency means that the half of the advantages is lost which can be obtained by using the microwave discharge in an ion source. The reduction in ion beam extraction efficiency can be avoided if an ion source having a discharge portion of rectangular cross section is manufactured instead of the conventional ion source having the coaxial cylindrical discharge portion, and the rectangular cross section is selected to be as great as the slit of 3 mm × 20 mm or greater than it. In an arrangement, however, in which the discharge portion is formed in a rectangular waveguide having a cross section of 3 mm × 20 mm, the frequency of the microwave introduced to this waveguide is on the order of about 50 GHz, but a microwave oscillator is now very expensive, which can generate the microwave having this frequency with a power on the order of kilowatts.

The present invention allows the microwave discharge in the discharge space of rectangular cross section using a commercially available microwave oscillator.

Figure 2:
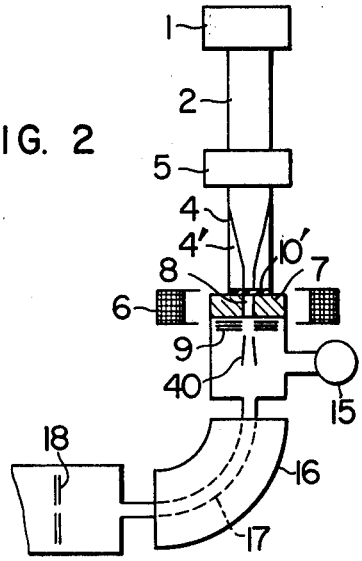
FIG. 2 is a schematic view showing a structure in which the microwave is transmitted through a ridged waveguide to a microwave discharge ion source according to one embodiment of the present invention in order to obtain only ions having a predetermined mass from an ion beam extracted from the ion source.

FIG. 2 is a cross section showing a total arrangement in which on embodiment of the present invention provided with a discharge space of rectangular cross section is coupled through a ridged waveguide and a rectangular waveguide to a commercially available microwave oscillator having a oscillation frequency of 2.45 GHz and oscillation power of 600 W in order to mass-separate an extracted ion beam by a DC magnetic field and introduce it to a device to be used. In FIG. 2, reference numeral 4 shows a ridged waveguide; 4' a ridge portion of the ridged waveguide; 5 a choke flange for coupling the rectangular waveguide 2 and the ridged waveguide 4; 7 an outer conductor of the discharge portion; 8 a discharge space; 15 a vacuum pump; 16 a pole piece for forming a sector field for mass separation; 17 a mass analysing tube disposed in the sector field; 18 a slit for providing a desired resolving power; and 40 an ion beam. Other reference numerals show the same parts or components as those in FIG. 1.

Figure 3A:
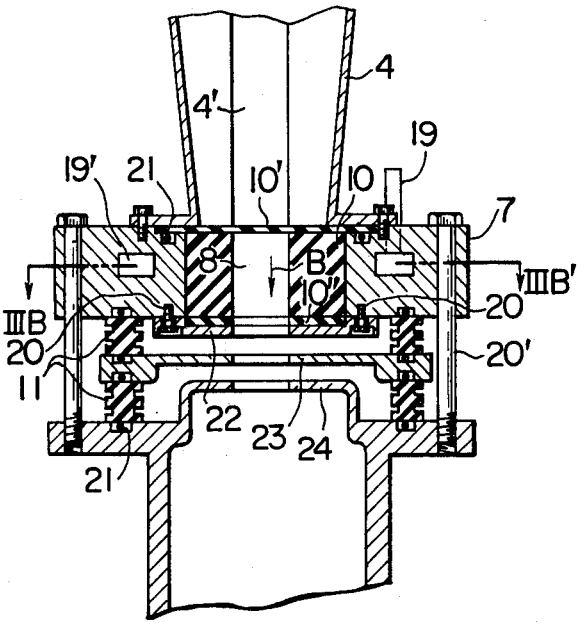
FIG. 3A is a detailed cross section showing an embodiment of the present invention, in which the microwave transmitted by the ridged waveguide is used.
Figure 3C:
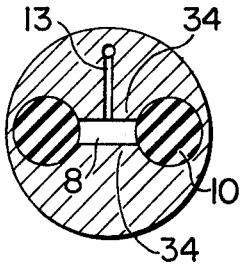
FIGS. 3C and 3D are cross sections showing variations of the embodiments shown in FIGS. 3A and 3B.
Figure 3B:
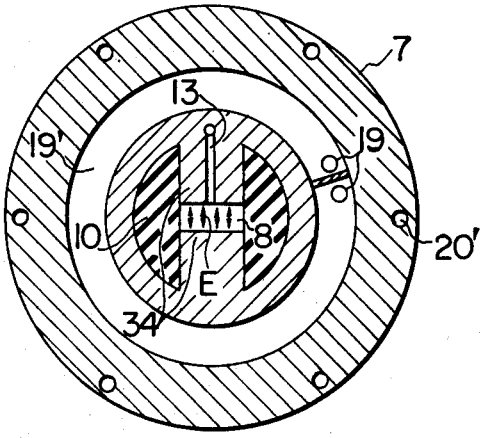
FIG. 3B shows a cross section along IIIB — IIIB' in FIG. 3A.

FIG. 3A is a cross section showing one embodiment of the present invention including a set of ridge electrodes coupled to the end of the ridge portions of the ridged waveguide to define an electrode gap which is used as a discharge space, and FIG. 3B shows a cross section along IIIB — IIIB' in FIG. 3A. Referring to FIGS. 3A and 3B, a metallic cylinder 7 constituting the discharge portion is coupled to the end surface of the ridged waveguide 4 through a vacuum-sealing material 10' (of boron nitride, for example,). A set of ridge electrodes 34 having a parallel opposing surface are formed integrally with the metallic cylinder 7 at positions corresponding to the ends of the ridges 4' of the ridged waveguide 4. The vacuum-sealing insulating material 10' has conductors vacuum-tightly fitted instead of the insulating material at the ends of the ridges 4' and at portions at which it comes into contact with the ridge electrodes 34 to thereby provide an electrical connection between the ridges and the ridge electrodes. The insulating material 10' is pressed against the metallic cylinder 7 through an O-ring gasket 21 to provide the vacuum-sealing. A microwave power transmitted by the ridged waveguide 4 causes a strong microwave field to be produced in the gap between the ridge electrodes 34, and a magnetic field B is generated in the axial direction of the metallic cylinder 7 with the aid of a coil (not shown) provided at the outside of both ends of the metallic cylinder 7. The microwave field and the magnetic field B maintain the microwave discharge between the ridge electrodes. The microwave discharge causes the formation of plasma of a gas supplied through a gas introducing hole 13 which is provided at the metallic cylinder 7. The metallic cylinder 7 is coupled at the other end portion to a dielectric disk 10'', which is provided with a rectangular window corresponding to the gap of the ridge electrodes. The inside of the metallic cylinder 7 is filled with a dielectric 10 with the exception of the gap of the ridge electrodes. The ridge electrodes 34 and the dielectric cooperate to define a rectangular parallelpiped discharge space 8. It is to be noted that the dielectric 10 also operates as a gap for matching the microwave. The dielectric 10 is, for example, made of boron nitride. The discharge space 8 is, for example, 3 mm × 20 mm × 20 mm great. The metallic cylinder 7 is provided in its inner portion with a ring-like gap 19', into which cooled water is caused to flow through a pipe 19. The cooled water prevents the O-ring gasket 21 from suffering a damage due to heat developed by the plasma. An ion extracting system is provided which comprises a positive electrode 22, a negative electrode 23 and a grounded electrode 24, these electrodes being insulated from one another by insulating materials 11. Each electrode is provided with a slit having an area corresponding to that of the cross section of the discharge space, for example, a slit of 3 mm × 20 mm, through which ions are taken out of the plasma produced in the discharge space 8. The gas introducing port 13 is coupled to an external gas introducing system (not shown) for supplying a desired gas. A gas required to produce desired ions is introduced to the discharge space 8 through the port 13.

The discharge portion shown in FIGS. 3A and 3B has a structure in which a set of ridge electrodes 34 are projected within the metallic cylinder 7 and filled with the dielectric 10 on both their sides. Such a structure is, however, complicated in manufacturing.

Figure 3D:
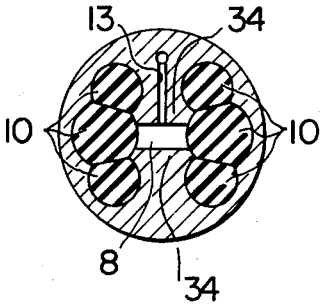

FIG. 3C shows the cross section of a discharge portion having a structure different from the above. In this arrangement, a hole of rectangular cross section is provided for defining the discharge space 8 along the axis of a metallic round bar, and the hole is further provided at both its smaller sides with another holes of circular cross section, into which a pair of cylindrical dielectrics 10 are filled. This structure is manufactured more easily than that shown in FIGS. 3A and 3B. In FIG. 3C, the discharge portion has a cut-off wavelength of about 10 cm for the ridge electrodes 34 having the distance of 5 mm and the width of 20 mm and for the dielectrics 10 made of the round bar of boron nitride 15 mm in diameter. Considering that the specific dielectric constant of boron nitride is about 4, the wavelength of about 6 cm is obtained when the microwave transmitted from a microwave oscillator having the oscillation frequency of 2.45 GHz is propagated along the discharge portion. The transmitted microwave is, therefore, not cut off in the discharge portion, but used to cause the microwave discharge to occur and generate a plasma. The increase in volume of the dielectric 10 used in the discharge portion makes it possible to increase the cut-off frequency. FIG. 3D shows the cross section of the discharge portion having the increased cut-off frequency. As is apparent from the FIGURE, six bars of dielectric 10 are filled to increase the volume of the dielectric in comparison with the structure in FIG. 3C. The structure in FIG. 3D can be manufactured relatively easily as is the case with the structure in FIG. 3C.

Figure 4A:
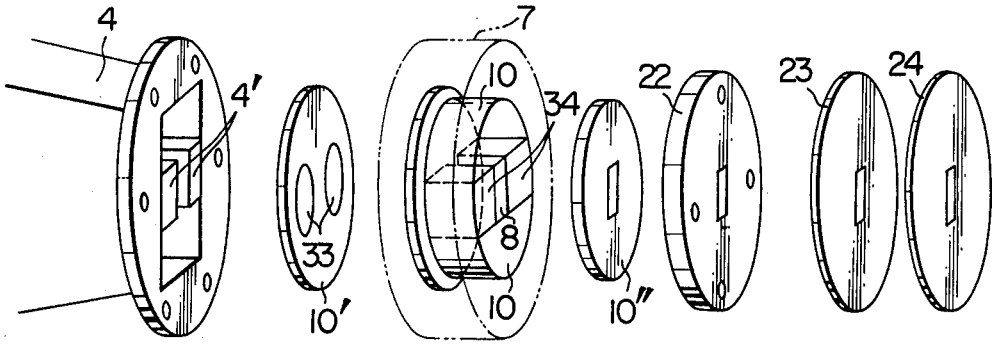
FIG. 4A is a view of assemblage for providing a more clear explanation of the structure of the embodiment shown in FIGS. 3A and 3B.
Figure 4B:
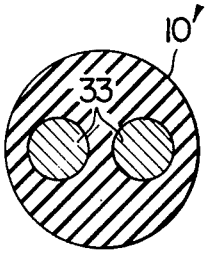
FIG. 4B shows a cross section parallel to parallel surfaces of a vacuum-sealing dielectric plate in FIG. 4A.

FIG. 4A is an assemblage view for making a more definite illustration of the structure as shown in FIGS. 3A and 3B. For convenience of simplicity, the illustration of portions of the water-cooling system and gas introducing system is removed from the FIGURE. As is apparent, the ridged waveguide 4, wacuum-sealing insulator 10', metallic cylinder 7 provided with the ridge electrodes 34 and the dielectric 10, dielectric disc 10'' and positive electrode 22 are successively coupled to one another and then the negative electrode 23 and the grounded electrode 24 are coupled thereto through an insulating material (not shown). FIG. 4B shows a cross section parallel to the parallel surfaces of the vacuum-sealing insulator. As shown, the conductor portions 33 are embedded vacuum-tightly. Such a structure makes easier the propagation of the microwave from the ridged waveguide 4 to the discharge space 8. The greater part of microwave discharge occurs in the electrode gap of the ridge electrodes even if the dielectric 10 is removed from the ion source shown in FIGS. 3A, 3B, 4A and 4B. It has been shown that an ion beam containing P+or B+ions and having the rectangular cross section can be extracted on the order of several tens of milliamperes (50 to 100 mA/cm$^2$ in current density) by introducing a gas of $PCl_3$, $BCl_3$, $BF_3$ or $B_2H_6$ from the gas introducing pipe using the embodiment of the present invention as shown in FIGS. 3A, 3B, 4A and 4B.

Figure 5:
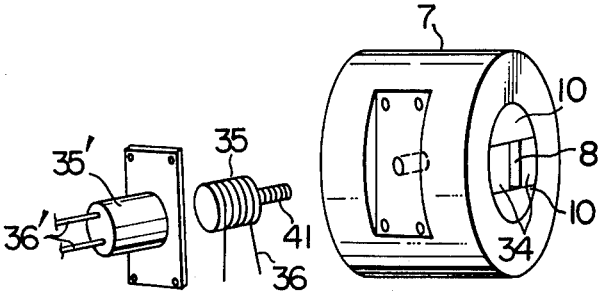
FIG. 5 is a view of assemblage showing an attachment for introducing a metallic vapor as a discharge gas in the embodiment shown in FIGS. 3A and 3B.

The description will be made of a structure for extracting ions of elements constituting a solid substance of metals, semiconductors, insulators or the like, using the above-mentioned ion source. FIG. 5 is a view of assemblage showing an arrangement for mounting an evaporation furnace on the ion source. As shown in the FIGURE, an evaporation furnace 35 capable of receiving therein a desired solid substance and being provided with a heater 36 is provided with a gas path 41, which is insertd into a small hole in the metallic cylinder. The evaporation furnace 35 is thus fixed to the metallic cylinder 7 through a cover equipped with an evaporation furnace casing 35' and terminals 36' leading to a heater. The terminals 36' are connected to a desired power supply (not shown) to provide a heating, which causes the solid substance in the evaporation furnace to be evaporated. The vapor is introduced into the discharge space 8 through the path 41 and changed to a plasma.

The introduction of the solid vapor to the discharge space by means of such a simple structure causes a drawback to arise when the vapor has conductivity. Much vapor generally adheres to the wall surfaces surrounding the discharge space when the vapor is introduced from the evaporation furnace to discharge space. Thus, a conductive film is formed also on the surface of the vacuum-sealing insulator defining one of the surfaces. The film prevents the propagation of the microwave from the ridged waveguide to the discharge space and stops the microwave discharge. The temperature in the discharge space is elevated to make the saturated vapor pressure of the introduced conductive substance higher than the introduced actual vapor pressure. This can prevent the formation of the conductive film on the wall surface.

Figure 6A:
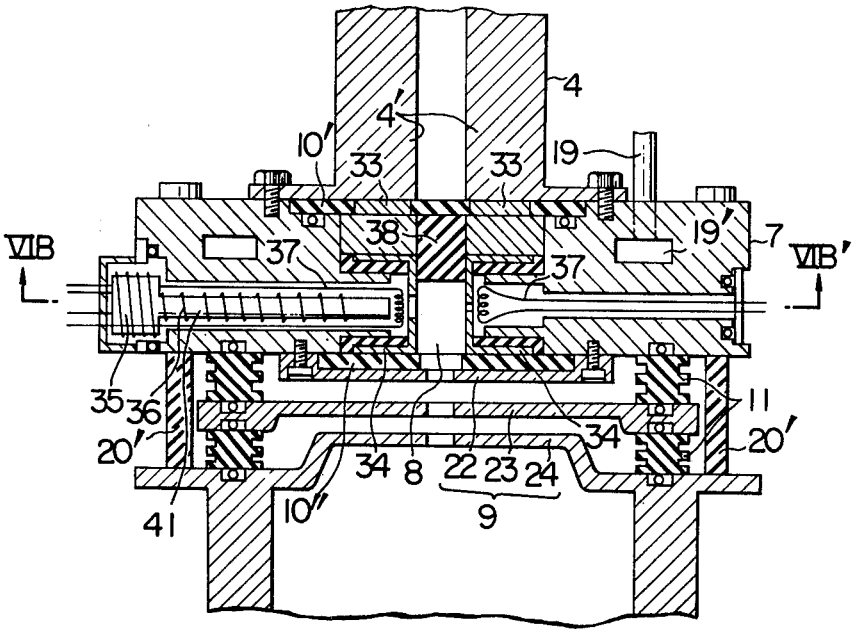
FIG. 6A is a cross section showing a structure in which the embodiment in FIGS. 3A and 3B is modified to generate a plasma of metallic vapor.
Figure 6B:
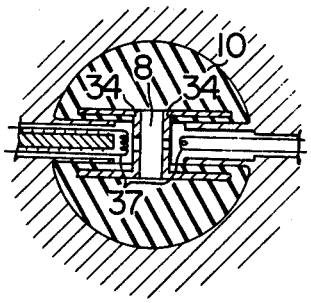
FIG. 6B is a view showing a portion of a cross section along VIB — VIB' in FIG. 6A.

FIG. 6A is a cross section of a structure in which the structure of the ion source as shown in FIGS. 3A and 3B is partially modified to control the temperature in the discharge space. FIG. 6B shows a cross section along VIB — VIB' in FIG. 6A. As shown in the FIGURES, heaters 37 for heating the discharge space are provided inside of the ridge electrodes 34 to elevate the temperature in the discharge space 8 and to prevent the adhesion of the conductive vapor to the wall surface. The ridge electrodes 34 are made of a thin metallic plate in this case, and an insulating material is inserted between the metallic cylinder 7 and the ridge electrodes 34 to prevent heat conduction from the ridge electrodes 34 to the metallic cylinder. An insulator is further provided between the discharge space 8 and the vacuum-sealing insulator 10' to prevent the thermal damage of the vacuum-sealing insulator 10'.

The description will next be made in what manner the temperature in the discharge space 8 is controlled to make it possible to prevent the adhesion of the metallic vapor to the wall surface. For simplicity, the description will be made in an example where no microwave discharge occurs. Assuming that $P_1$, $P_2$, $P_3$ are the vapor pressure of the solid substances in the evaporation furnace 35, discharge space 8 and at a position outside of the slit of the grounded electrode 24, respectively, the amount Q of vapor flowing from the evaporation furnace 35 towards the grounded electrode is given by the following expressions:

$$Q = (P_1 - P_2)C_1 = (P_2 - P_3)C_2 \quad (1)$$

$$P_1 > P_2 > P_3 \quad (2)$$

where $C_1$ is a conductance of the gas path from the evaporation furnace to the discharge space and $C_2$ is a conductance of a flow path from the discharge space to the outer portion of the grounded electrode. The pressure of the vapor decreases remarkably outside of the grounded electrode due to the vacuum pumping effected thereat and the adhesion of the vapor to the container, so that $$P_2 >> P_3 \quad (3)$$

Therefore, $$(P_1 - P_2)C_1 = P_2C_2 \quad (4)$$

That is, $$P_2 = (C_1/C_1 + C_2)P_1 \quad (5)$$

On the other hand, the saturated vapor pressure $P_s$ of the vapor at a temperature T is given by the following expression, $$\log P_s = -\frac{A}{T} + B \quad (6)$$

That is, $$T = \frac{A}{B - \log P_s} \quad (7)$$

where each of $A$ and $B$ is a constant depending upon the substance. If the temperature $T_2$ in the discharge space is elevated higher than a temperature at which the pressure $P_2$ becomes a saturated vapor pressure, then the vapor can be prevented from being deposited on the wall surface of the discharge space. This fact can be expressed using the equations (5) and (7) as follows:

$$T_2 > \frac{A}{B - \log P_2} = \frac{A}{B - \log P_1 + \log\left(1 + \frac{C_2}{C_1}\right)} \quad (8)$$

The right side of the expression (8) shows a temperature lower than the temperature $T_1$ in the evaporation furnace. If the temperature in the discharge space 8 is elevated to a value satisfying the expression (8), then the vapor of the solid substance introduced into the discharge space doesn't deposit on the wall surface. This, therefore, eliminates the prevention of propagation of the microwave due to the formation of the above-mentioned conductive film, and assures the continuation of the strong microwave discharge.

When, in the structure as shown in FIGS. 6A and 6B, the conductance $C_1$ of the vapor path 41 is made smaller than the conductance $C_2$ of an extracting lens system 9 comprising the electrodes 22, 23 and 24, then $P_1 >> P_2$, and thus $$Q \approx P_1C_1 \quad (9)$$

from the expression (1). In other words, the flow $Q$ of the vapor is proportional to the vapor pressure $P_1$ in the evaporation furnace. The vapor pressure $P_1$ is a function of the temperature in the evaporation furnace, so that the temperature can be controlled independently of the temperature in the discharge space to controll the amount of flow $Q$.

Figure 7:
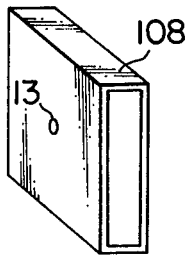
FIG. 7 is a perspective view showing a casing inserted into the discharge space of the embodiment shown in FIGS. 3A and 3B.

In any structure that has been shown above, the surfaces of the ridge electrodes 34 are exposed to the discharge space. In such structures, the surfaces of the electrodes 34 are subjected to sputtering by the ions in the plasma upon the microwave discharge. The constituent atoms of the electrodes are ionized in the plasma, causing the problem that they are taken out together with the desired ions. The covering of the surface of ridge electrodes with an insulating material containing the element of the desired ion allows the problem to be overcome and the yield of ions to be increased with the aid of the sputtering. FIG. 7 is a perspective view showing a casing of an insulating material inserted into the discharge space 8. For an example in which the casing is made of boron nitride and a gas containing boron is introduced into the discharge space to generate the plasma and extract boron ions therefrom, the boron atoms from the casing subjected to the sputtering are ionized in the plasma and extracted as ions together with the boron ions formed from the boron in the introduced gas with the result of the increase in the yield of boron ions.

The ion source is generally biased to a positive or negative high potential to extract therefrom positive or negative ions. In a microwave transmitting system in which the microwave ion source of the present invention is brought into DC electrical connection with the microwave oscillator, rectangular waveguide and the ridged waveguide, these are all biased to a high potential, and a difficult problem arises from the viewpoint of insulation. In order to eliminate the drawback, a choke flange is provided between the reactangular waveguide 2 and the ridged waveguide 4, as shown in FIG. 2.

Figure 8:
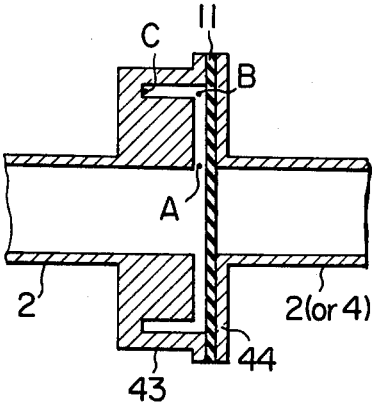
FIGS. 8 to 10 are a cross section showing a choke flange adapted for use in coupling various embodiments of the microwave discharge ion source according to the present invention to the microwave oscillator.

FIG. 8 is a cross section showing the structure of a choke flange used to couple rectangular waveguides to each other or a rectangular waveguide to a ridged waveguide. In the figure, 11 shows an insulator plate, 43 a choke flange provided at the end portion of the waveguide 2, and 44 a flange provided at the end portion of the waveguide 2 or 4. The choke flange is formed with a recess at a surface corresponding to a portion AB of the choke flange 43 and with a rectangular slot at a position corresponding to a portion BC thereof. The distances from A to B and from B to C are all one-fourth the wavelength of the microwave to be transmitted. In such a structure, the microwave incoming from a point A to the recess passes through a point B and reflects at a point C to form a standing wave in cooperation with the reflected wave, and no current flows on the wall surface at the point B because of the one-fourth wavelength of the distance between the points B and C. There is, therefore, no fear of the leakage of the microwave from the point B through a gap. Considering that the distance from A to C is one-half wavelength, the impedance is zero as viewed from the point A to the slot, and therefore no slot exists in the sense of the microwave. The microwave is, therefore, transmitted without reflection at this portion and thus without any substantial loss, while direct current is completely interrupted by the insulator plate 11.

Figure 9:
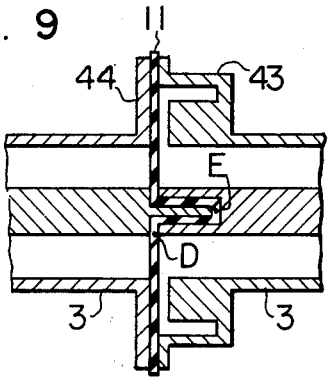
Figure 10:
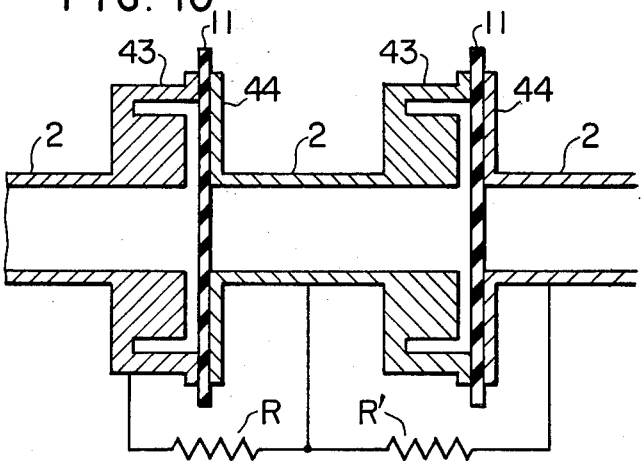

FIG. 9 is a cross section showing the structure of a choke flange used to couple coaxial lines to each other. An ion source according to one embodiment of the present invention to be described later is coupled to the coaxial line, which transmits the microwave from the oscillator to the ion source. It is recommended that the choke flange in FIG. 9 should be used when such an ion source is employed. Referring to FIG. 9, a choke flange having a structure similar to that of FIG. 8 is provided at the end portion of the outer conductor of the coaxial line 3. The inner conductor is provided with a slot at its end portion with a distance between D and E being one-fourth wavelength. The insulator plate 11 with a projection at its center is fitted into the slot, while the inner conductor of the coaxial line on the left side is provided with a projection, which is fitted into the projection of the insulator plate 11. In this case, the inner conductors are short-circuited in the sense of the microwave and insulated from each other in the sense of direct current with effects similar to those in FIG. 8 obtained. A plurality of choke flanges are needed to insulate a DC high voltage as high as several tens of kilovolts or more. FIG. 10 shows an arrangement in which two choke flanges are used to couple the rectangular waveguides for voltage distribution. In the FIGURE, resistors R and R′ are used to divide the DC voltage at a desired ratio and apply it to each choke flange. A multiplicity of choke flanges are provided in a manner similar to that shown in FIG. 10, to make it possible to insulate a DC voltage higher than 100 kilovolts.

The description has above been made in detail of the structure of the ion source, one embodiment of the present invention, provided with a set of ridge electrodes having the discharge space of rectangular cross section defined therebetween, and of the modifications made for use in various applications as well as the choke flange used when the ion source is employed.

In the following, another embodiments according to the present invention will be described.

Figure 11:
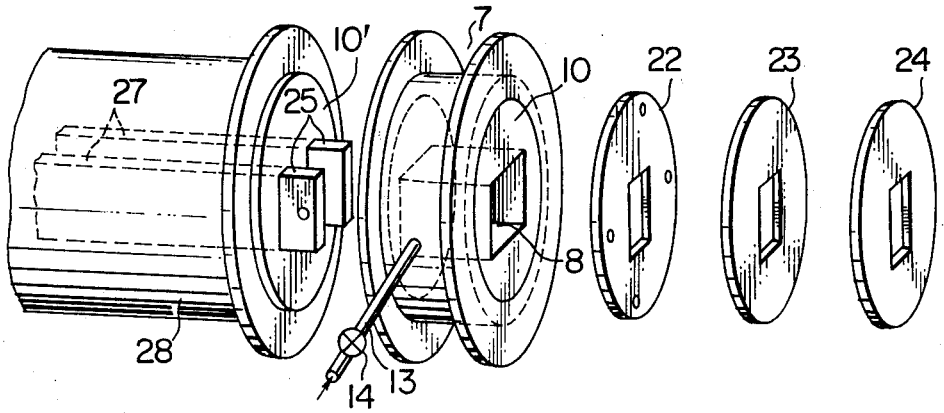
FIG. 11 is a view of assemblage showing another embodiment of the present invention in which the micro-wave discharge ion source employs parallel plate electrodes.

FIG.11 is a view of assemblage showing another embodiments of the present invention, a microwave discharge ion source provided with a set of parallel plate electrodes to define an electrode gap, that is, a discharge space. For simplicity, only essential parts are shown in the FIGURE. Also in such a structure, the suitable selection of the electrode distance and the size of the electrodes allow the discharge space to have a desired rectangular cross section perpendicular to a direction along which the ion beam is taken out. Referring to FIG. 11, the microwave is transmitted to the discharge portion through a parallel plate transmission path 27 disposed within a shielding pipe 28. The pipe 28 is coupled at its end portion to the metallic cylinder 7 in the discharge portion through the vacuum-sealing insulating material 10′. The parallel plate electrodes 25 disposed in the metallic cylinder 7 are formed, for example, by projecting the transmission path 27 vacuum-tightly through the insulating material 10′. Thus, the electrodes 25 and the transmission path 27 come into electrical connection also in the insulator. The dielectric 10 is filled within the metallic cylinder and provided at its central portion with a hole, into which the electrodes 25 are inserted. The dielectric 10 prevents the microwave discharge in a portion other than the electrode gap. The positive electrode 22 with a rectangular slit is coupled to the metallic cylinder 7 by means of a screw. The parallel plate electrodes 25 elongate from the vacuum-sealing insulator 10, to such an extent that it doesn't reach the right end portion of the metallic cylinder when they are assembled. There is, therefore, no danger of any contact of the electrodes 25 with the electrode 22. The negative electrode 23 and the grounded electrodes 24 are successively coupled through an insulating material (not shown). A magnetic field produced by a magnetic field coil (not shown) in an axial direction of the metallic cylinder 7 causes the microwave discharge to occur in the electrode gap of the electrode 25 in cooperation with the transmitted microwave to generate the plasma of a gas introduced through the gas path 13. The ions in the plasma are extracted as an ion beam having a rectangular cross section through the slits of the electrodes 22, 23 and 24.

Figure 12A:
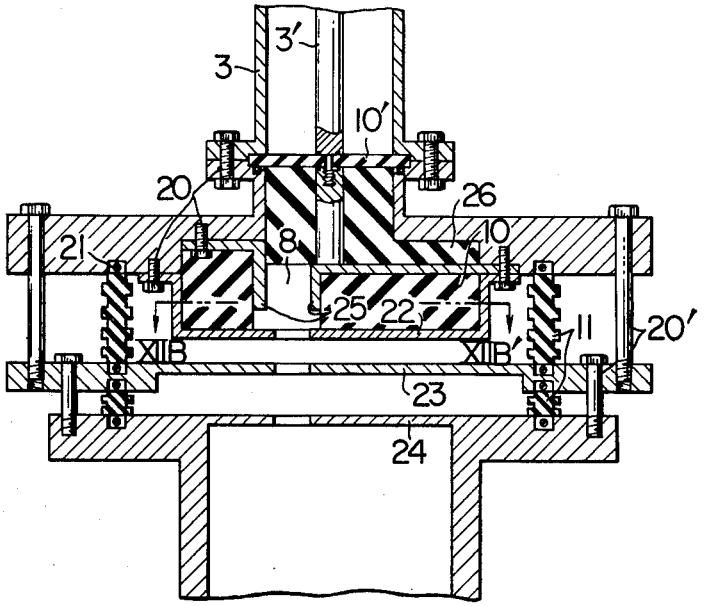
FIG. 12A is a cross section showing still another embodiment of the present invention including parallel plate electrodes and capable of being coupled to a coaxial line.
Figure 12B:
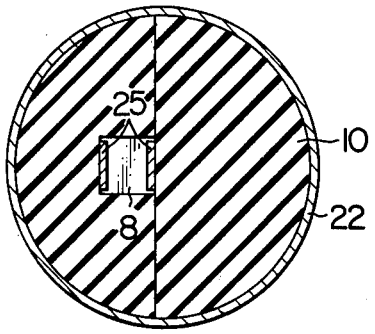
FIG. 12B shows a cross section along XIIB — XIIB' in FIG. 12A.

FIG. 12A is a cross section showing still another embodiment of the present invention. In this embodiment, the microwave discharge ion source is provided with a coaxial line portion and parallel electrode portion to define a discharge space between the parallel electrodes. As is apparent from the FIGURE, the coaxial line 3 along which the microwave is transmitted is coupled to the coaxial line portion through the vacuum-sealing insulator 10'. In this case, the inner conductors in both the coaxial lines are vacuum-tightly coupled to each other through a hole provided at the center of the insulator 10'. The dielectric is filled between the outer and inner conductors in the coaxial line portion and provided at its end portion with a short-circuiting terminal portion 26 of a semicircular shape having a radius of one-fourth wavelength. This serves to match the impedance between the coaxial line portion and the parallel electrode portion. As is apparent from FIG. 12B showing the cross section along XIIB — XIIB' in FIG. 12A, the parallel electrodes 25 are provided at a very limited portion of the parallel electrode portion. The dielectric 10 is filled in the proximity of the electrodes 25 with the exception of the electrode gap, and the microwave discharge occurs only in the electrode gap. It is to be noted that the greater part of the microwave discharge occurs in the electrode gap without the dielectric 10.

Figure 13A:
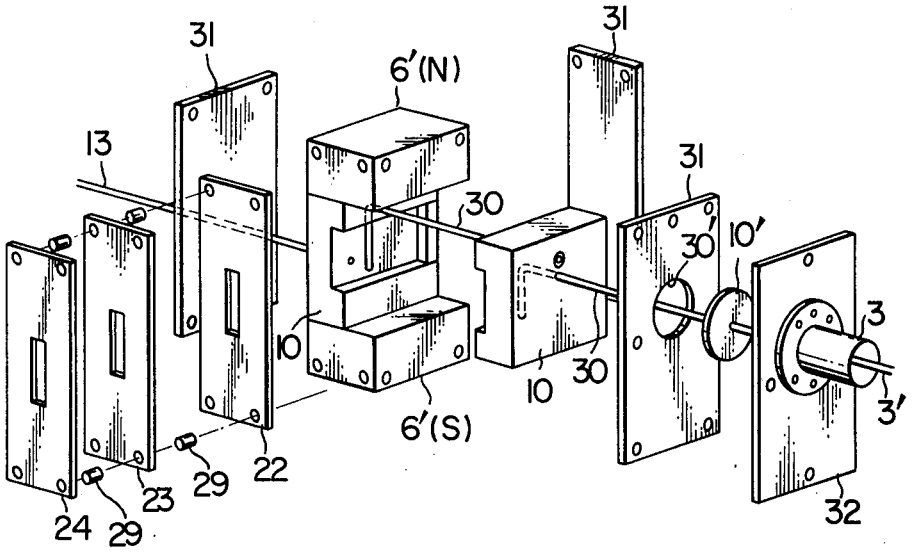
FIG. 13A is a view of assemblage showing yet still another embodiment of the present invention in which the microwave discharge is caused to occur by Lecher wires.
Figure 13B:
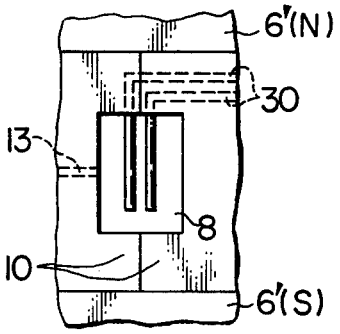
FIG. 13B is a view showing a part of a discharge portion of the embodiment in FIG. 13A, as viewed from a direction along which the ion beam is extracted.

FIG. 13A is a view of assemblage showing another embodiment of the present invention different from those described above. As is apparent from the FIGURE, a set of dielectrics 10 each having a notch are coupled to define a rectangular parallelepiped discharge space 8 with the aid of the notches, Lecher wires are disposed at the central portion of the discharge space 8, as shown by FIG. 13B obtained when viewed from the electrode 22 toward the discharge space. The microwave is transmitted to the Lecher wires through a coaxial line. Reference numeral 31 shows conductive members constituting the walls of the discharge portion. Magnetic poles 6'(N) and 6'(S) are further coupled to the upper and lower surfaces of the dielectrics to generate a magnetic field perpendicular to the microwave electric field produced between the Lecher wires inthe discharge space.

As described above, various embodiments of the present invention have been described, but it should be understood that the present invention is not limited to these embodiments, but their modifications can be made without departing from the spirit and scope of the present invention.

What is claimed is:

1. A microwave discharge ion source comprising a set of conductive members for producing a microwave electric field therebetween, means for generating a magnetic field in a direction perpendicular to said microwave electric field, means for introducing a sample gas or vapor, at least one extraction electrode for taking ions out of a plasma produced by a microwave discharge which occurs in the atmosphere of the introduced sample gas or vapor in cooperation with said microwave electric field and said magnetic field, and a vacuum-sealing insulator provided at an end portion opposite to the end portion at which said extraction electrode is provided, wherein said set of conductive members are a set of electrodes having their surfaces arranged in opposing and substantially parallel relationship; a discharge space defined in the proximity of an electrode gap between said electrodes has a cross section substantially rectangular in a plane perpendicular to a direction along which the ions are extracted; said extraction electrode is provided with a slit having substantially the same pattern as that of said rectangular cross section, an ion beam having a rectangular cross section being extracted through said slit; and said vacuum-sealing insulator is made of a conductor material at a position at which it comes into contact with said electrodes, said conductor material being vacuum-tightly attached to said vacuum-sealing insulator.

2. A microwave discharge ion source according to claim 1, wherein a dielectric is disposed between said electrodes and a member defining the outer periphery of the ion source, the discharge space for the microwave discharge being defined by said dielectric and said electrodes.

3. A microwave discharge ion source according to claim 2, wherein said dielectric is filled between said set of electrodes and said member defining the outer periphery of the ion source to thereby define said discharge space only in the electrode gap, said discharge space having a substantially rectangular cross section perpendicular to a direction along which the ions are extracted.

4. A microwave discharge ion source according to claim 1, wherein said set of electrodes are ridge electrodes coupled to a conductive member defining the outer periphery of the ion source, said ridge electrodes coming into electrical connection with ridges of a ridged waveguide for transmitting said microwave through said conductor portion of said vacuum-sealing insulator.

5. A microwave discharge ion source according to claim 3, wherein said set of electrodes are ridge electrodes coupled to a conductive member defining the outer periphery of the ion source, said ridge electrodes coming into electrical connection with ridges of a ridged waveguide for transmitting said microwave through the conductor portion of said vacuum-sealing insulator.

6. A microwave discharge ion source according to claim 1, wherein said electrodes are a set of parallel plate electrodes.

7. A microwave discharge ion source according to claim 6, wherein a dielectric is inserted into the inner portion of a member defining the outer periphery of the ion source and provided with an aperture substantially rectangular as viewed from a direction along which the ions are extracted, said discharge space being defined by said aperture, into which said parallel plate electrodes are inserted.

8. A microwave discharge ion source according to claim 1, wherein said ion source is provided with a coaxial line portion coupled to a coaxial line transmitting the microwave; said vacuum-sealing insulator is coupled to one end of the coaxial line portion; a dielectric is filled between inner and outer conductors of said coaxia line portion; said coaxial portion is provided at the other end with a terminal for short-circuiting the microwave; and said set of electrodes for generating the microwave in the electrode gap are parallel plate electrodes, which are attached to the other end of the coaxial line portion.

9. A microwave discharge ion source according to claim 8, wherein a dielectric is filled between parallel plate electrodes and a member defining the outer periphery of the ion source.

10. A microwave discharge ion source according to claim 9, wherein said microwave short-circuiting terminal is a one-fourth wavelength short-circuiting terminal comprising a semi-circular dielectric.

11. A microwave discharge ion source according to claim 1, wherein said electrodes are Lecher wires.

12. A microwave dischrge ion source according to claim 2, wherein said electrodes are Lecher wires.

13. A microwave discharge ion source according to claim 12, wherein said dielectric is provided with a recess substantially rectangular as viewed from a direction along which the ions are extracted to thereby define said discharge space; the end portions of the Lecher wires constituting the electrodes are disposed in said recess in parallel relationship; and magnetic poles are provided at a set of parallel outer surfaces of the dielectric, said poles constituting a portion of the member defining the outer periphery of the ion source.

* * * * *